US010422089B1

(12) United States Patent
Devine

(10) Patent No.: US 10,422,089 B1
(45) Date of Patent: Sep. 24, 2019

(54) LIGHT REFLECTOR APPARATUS WITH MECHANICAL FORCE ATTACHMENT PORTION

(71) Applicant: Mark Devine, Copperopolis, CA (US)

(72) Inventor: Mark Devine, Copperopolis, CA (US)

( * ) Notice: Subject to any disclaimer, the term of this patent is extended or adjusted under 35 U.S.C. 154(b) by 145 days.

(21) Appl. No.: 15/249,145

(22) Filed: Aug. 26, 2016

Related U.S. Application Data

(63) Continuation of application No. 62/215,878, filed on Sep. 9, 2015.

(51) Int. Cl.
*E01F 9/619* (2016.01)
*E01F 9/524* (2016.01)

(52) U.S. Cl.
CPC ..... *E01F 9/619* (2016.02); *E01F 9/524* (2016.02)

(58) Field of Classification Search
CPC ..... G02B 5/12; G02B 5/124; G02B 5/128; G02B 15/173; G02B 3/0006; G02B 3/0037; G02B 3/0043; G02B 3/005; G02B 5/045; G02B 5/126; G02B 13/02; G02B 2027/0194; G02B 27/01; G02B 27/0101; G02B 5/30; E01F 9/619; E01F 9/669; E01F 9/20; E01F 9/40; E01F 9/524; E01F 9/553; E01F 15/0453; E01F 15/06; E01F 9/541; E01F 9/582; E01F 9/61; E01F 9/654; E01F 15/003; E01F 9/007; E01F 9/015; E01F 9/03; E01F 9/044; E01F 9/518
See application file for complete search history.

(56) References Cited

U.S. PATENT DOCUMENTS

| | | | | |
|---|---|---|---|---|
| 3,802,378 A * | 4/1974 | Kessler | E01F 9/619 116/63 P |
| 4,088,415 A * | 5/1978 | Syak | E01F 7/06 256/1 |
| 4,245,922 A * | 1/1981 | Auriemma | E01F 9/629 256/1 |
| 2013/0039700 A1* | 2/2013 | Philip | E01F 9/608 404/14 |
| 2013/0279178 A1* | 10/2013 | Trudel | F21V 7/00 362/341 |

OTHER PUBLICATIONS

US Reflector, JBR Barrier Reflectors—High Power Hwy Reflectors Aug. 2016.*
US Reflector, JBR Barrier Reflectors—High Power Hwy Reflectors.

* cited by examiner

*Primary Examiner* — Evan P Dzierzynski
*Assistant Examiner* — Sharrief I Broome
(74) *Attorney, Agent, or Firm* — John P. Costello; Costello Law Corp.

(57) ABSTRACT

The inventive light reflector employs a reflector portion which bears a light reflector and an adjoining attachment portion which is adapted to attach to roadway structures such as Jersey barriers and road stakes using applied mechanical force. By using mechanical force as a way to attach to roadway structures, the present invention avoids having to employ messy adhesives, screws or other complicated fastening methods.

9 Claims, 7 Drawing Sheets

LIGHT REFLECTOR APPARATUS WITH MECHANICAL FORCE ATTACHMENT PORTION

1. RELATED APPLICATIONS

This application claims the benefit of U.S. Provisional Application Ser. No. 62/215,878, filed on Sep. 9, 2015

2. TECHNICAL FIELD

This invention relates to light reflectors for roadway structures, and more specifically, to a light reflector which uses mechanical force to attach to temporary and permanent roadway structures.

3. BACKGROUND

Light reflectors for roadway applications have been in use for many years. Reflectors define roadway lanes and turn lanes to name some applications. Other uses include roadside stakes having reflectors to define road shoulders. What is apparent, is that roadway technology has long embraced the use of light reflectors, in a variety of applications, to help drivers navigate roadways and to avoid obstacles, especially at night.

What is less apparent, are light reflectors which can be attached to temporary roadway structures such as temporary road stakes and cement barriers. These temporary structures, especially in the case of temporary cement barriers, often called "Jersey barriers", can present formidable dangers to drivers if they are not illuminated. Cement barriers are used extensively to divide lanes, define road shoulders, and divert traffic and often, especially at night, their presence does not register in an average driver's mind until the last few seconds when a vehicle's headlights illuminate the barriers.

American Molded Plastic of Newton Falls, Ohio offers a cement barrier reflector which is combined with a bracket that is glued onto a cement barrier to provide reflective capability. However, glue application is messy and requires specialized glue application tools. Also, if the reflectors are glued to the barrier top surface, this negates stacking barriers on top of one another for storage, lest the glued reflectors be broken off, necessitating re-gluing when they are used again. Moreover, these glue-on style barrier reflectors cannot be used in any other temporary roadway structures, such as road stakes, to name one example A need therefore exists for a light reflector which can be applied to temporary or permanent roadway structures which does not necessitate the use of glue, brackets, or complicated tools for attachment. Additionally, a need exists for a light reflector that is capable of attachment to more than one roadway structure, thus allowing flexibility in helping to illuminate a variety of structures for increased safety.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is a light reflector apparatus for roadway applications which uses mechanical force to attach to cement road barriers and other structures, including road stakes.

The inventive light reflector employs a reflector portion which bears a light reflector and an adjoining attachment portion which is adapted to attach to roadway structures using applied mechanical force. By using mechanical force as a way to attach to roadway structures, the present invention avoids having to employ messy adhesives, screws or other complicated fastening methods. Also, by employing mechanical force as a method of attachment, the present invention can be easily removed from roadway structures by releasing the mechanical force. As such the invention can be re-used indefinitely to attach to various roadway structures.

Further objects and advantages of the invention will be brought out in the following portions of the specification, wherein the detailed description is for the purpose of fully disclosing the preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

The light reflector apparatus of the present invention employs applied mechanical force as a method of attachment to various roadway structures, thereby obviating the need to employ messy adhesives, screws, or other methods of attachment. This invention takes advantage of structural features present on roadway structures to employ its mechanical force attachment feature. The invention is comprised of a light reflector portion and a connected attachment portion, wherein the attachment portion is pliable and tending toward retaining its shape upon being pliably manipulated by mechanical force. The mechanical force applied to the attachment portion is primarily simple hand manipulation of the pliable attachment portion, but tools can also be used. In use, a construction worker, for example, would manipulate the pliable attachment portion to render it into a shape that can be fitted into crevice or cavity of a roadway structure and retain the light reflector apparatus therein.

Figure 1:
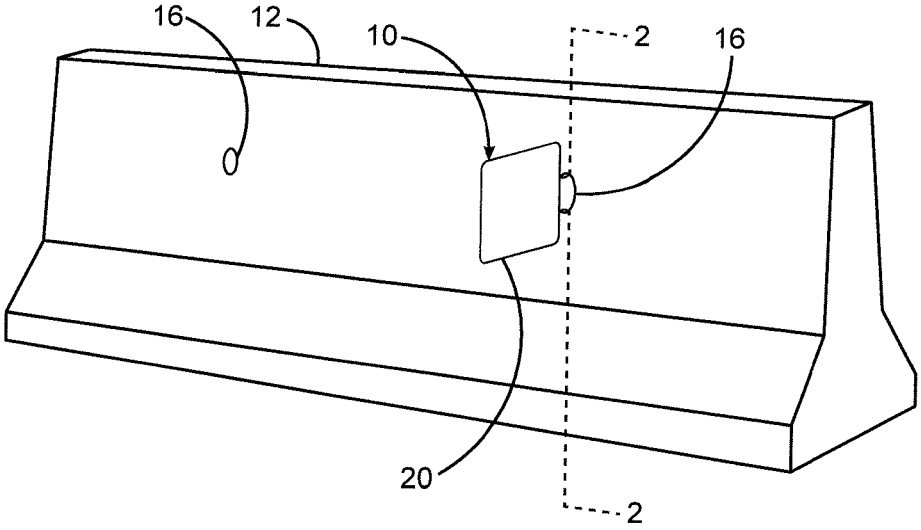
FIG. 1 is a side perspective view of a cement roadway barrier shown with the invention attached to it.

One example of a roadway structure to which the invention 10 has application are cement barriers, sometimes called "Jersey barriers". Referring to FIG. 1, a typical cement barrier 12 is shown with an example of the invention 10 attached to it by applied mechanical force being supplied by the attachment portion 14. Cement barriers 12 typically have two or more tunnels 16 imparted transversely through the body 18 of the cement barrier 12. These tunnels 16 are used to attach chains for craning the barriers 12 into place at a desired location. If craned into place along a roadway, the cement barriers present formidable obstacles which drivers need to avoid, especially in temporary road construction zones. To make the cement barriers visible, it has been a past practice to attach reflectors by gluing or screwing them to the barriers. The inventive light reflector apparatus 10 attaches by applied mechanical force as shown in FIG. 1, where the tunnels 16 in the barrier 12 provide an enclosed space against which the attachment portion 14 can gain purchase.

Figure 2:
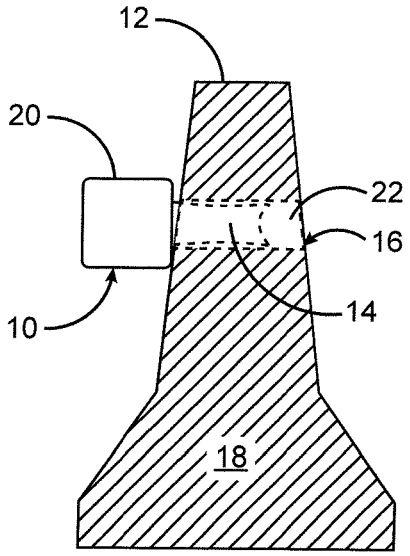
FIG. 2 is a cross sectional view through line 2-2 of the cement barrier shown in FIG. 1, showing a tunnel through the barrier having the invention attached therein.

FIG. 2 shows a cross section through a cement barrier 12 of the same type introduced in FIG. 1, showing a tunnel 16 through the barrier 12, having the invention 10 attached therein. As shown the reflector portion 20 protrudes outside of the tunnel 16, thus creating a visible light reflector for oncoming traffic. The attachment portion 14 is pliable and can be formed by hand pressure or tools to fit inside of the tunnel 16. Upon releasing the attachment portion 14 inside of the tunnel 16, it will expand in an attempt to revert back to its natural shape, however, the expansion will cease upon the attachment portion 14 encountering the sidewalls 22 of the tunnel 16. The mechanical force applied by the expansion of the attachment portion 14 against the tunnel sidewalls 22 serves to hold the light reflector apparatus 10 firmly in place. The applied mechanical force of the attachment portion 14 against the tunnel sidewalls 22 is strong enough to hold up against heavy winds and buffeting produced by passing vehicles.

Figure 3:
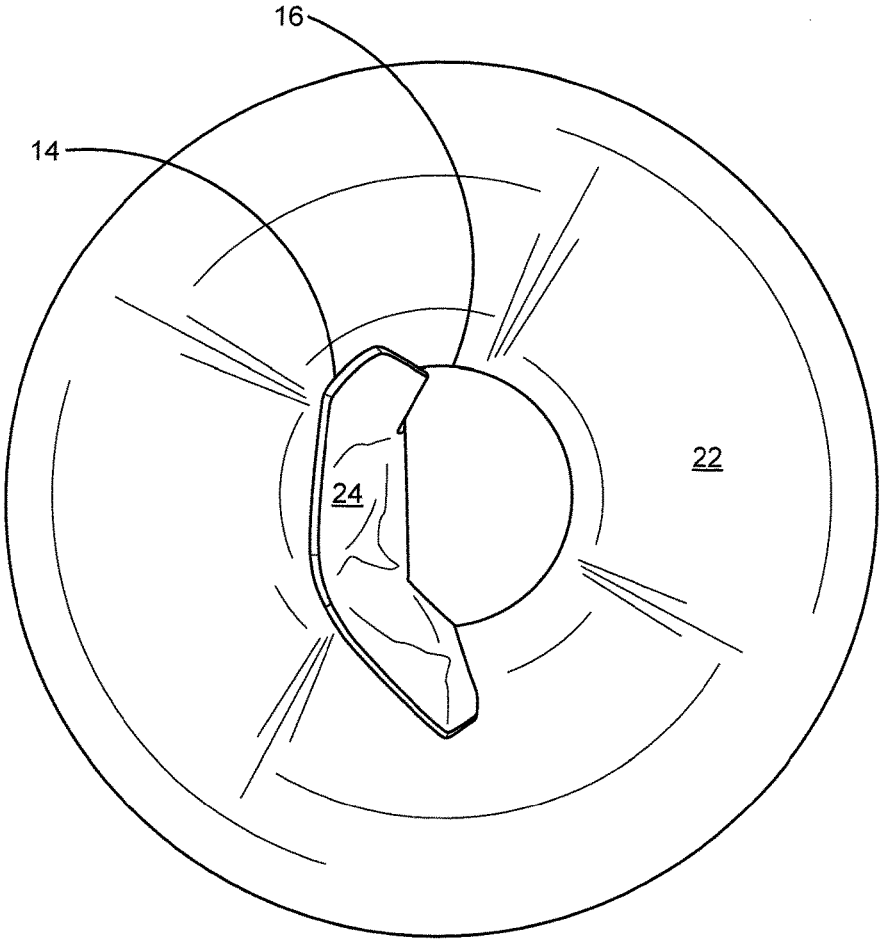
FIG. 3 represents an interior view of a tunnel of a cement barrier of the type introduced in FIG. 1, this view showing the attachment portion lodged in the tunnel and placing mechanical force against the tunnel sidewalls, thereby holding the light reflector apparatus firmly therein.

FIG. 3 represents an interior view of a tunnel 16 of a cement barrier 12, shown with the attachment portion 14 placing mechanical force against the tunnel sidewalls 22 and holding the light reflector apparatus 10 firmly therein. While the tunnels of a cement barrier provide one example of how the inventive apparatus can be used to illuminate a roadway structure, the invention 10 can be applied to any structure which provides a way for the attachment portion 14 to expand and place mechanical force against. A crevice in a roadway structure, or a space between roadway structures in which the attachment portion can expand and hold against are other possibilities.

Figure 4:
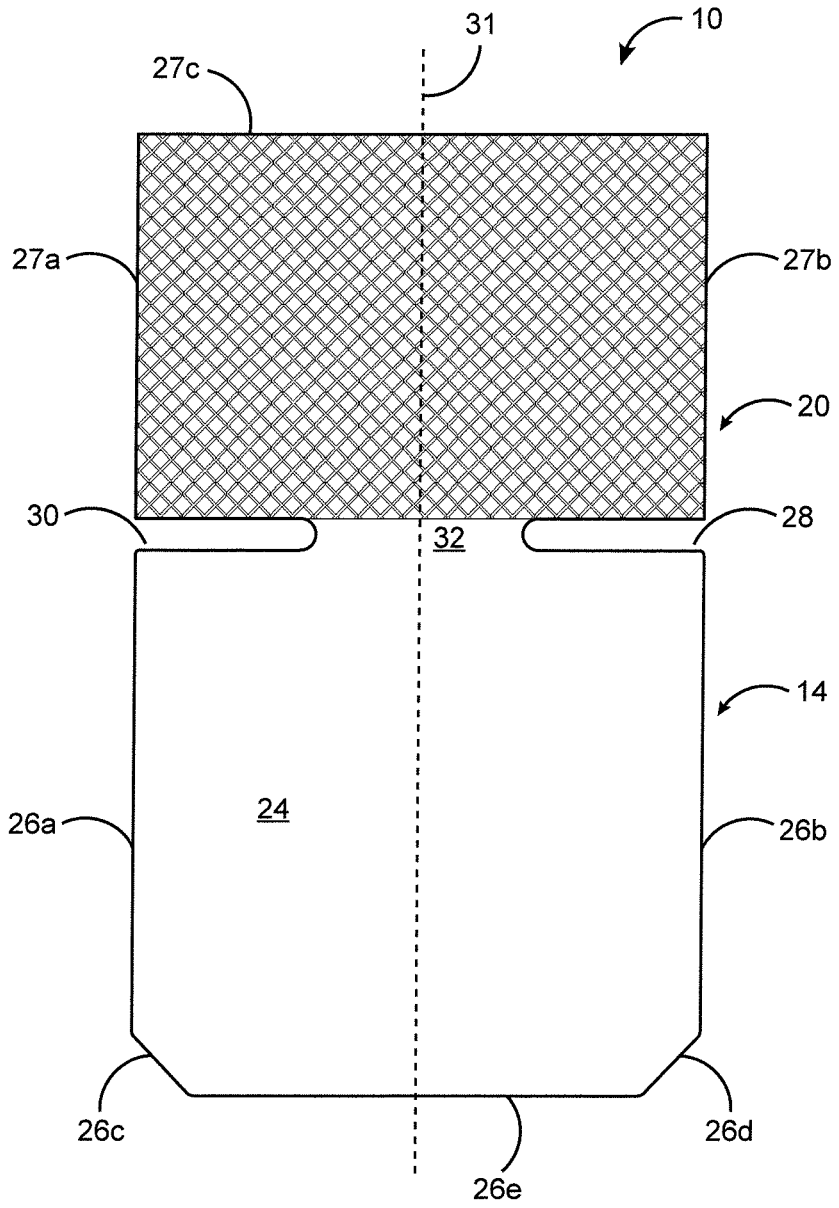
FIG. 4 shows a plan view of a first embodiment of the light reflector apparatus as it might appear in its natural resting shape prior to any application of mechanical force.

Referring to FIG. 4, the light reflector apparatus 10 is shown in its natural resting shape prior to any application of mechanical force. The attachment portion 14 is connected adjacent to the reflector portion 20. The attachment portion 14 is the component of the apparatus 10 that must be pliable enough to allow forming by simple hand or tool pressure, in order to fit the attachment portion 14 into a cavity, crevice or tunnel located on a roadway structure. The reflector portion 20 does not have a similar requirement of pliability for fitting into enclosed and semi-enclosed spaces, because it must remain visible to perform its function as a light reflector and therefore must remain outside of any cavities, crevices or tunnels present in a roadway structure. In one embodiment, the material from which the attachment portion 14 is formed is selected from the group consisting of flexible PVC (Polyvinylchloride), ABS (Acrylanitrile Butadiene Styrene) and Polypropylene. The thickness of the attachment portion 14 should be in the range of ⅛"-¼" to maintain good flexibility with the selected materials.

Still referring to FIG. 4, the attachment portion 14 has a body 24 defined by a first side 26*a*, a second side 26*b*, a first tapered side 26*c*, a second tapered side 26*d* and an end side 26*e*. The combination of these sides primarily define the perimeter of the attachment portion 14. First and second tapered sides 26*c* and 26*d* allow the attachment portion 14 to more easily insert into confined spaces of roadway structures such as tunnels and crevices. A first indentation 28 and a second indentation 30 define an additional part of the perimeter of both the attachment portion 14 and the reflector portion 20. The reflector portion 20 has a perimeter defined by first side 27*a*, second side 27*b* and an end side 27*c*. A flexible bridge 32 connects the reflector portion 20 to the attachment portion 14. First and second indentations 28, 30 and the flexible bridge 32 allow the attachment portion 14 a sufficient amount of play independent of the reflector portion 20 to be flexed and molded into shapes. The molding of the attachment portion 14 into shapes allows it to be fitted into cavities, crevices and tunnels of roadway structures, as already mentioned herein. The lengthwise combination of the reflector portion 20 connected to the attachment portion 14 together define the long axis 31 of the apparatus 10.

Figure 5:
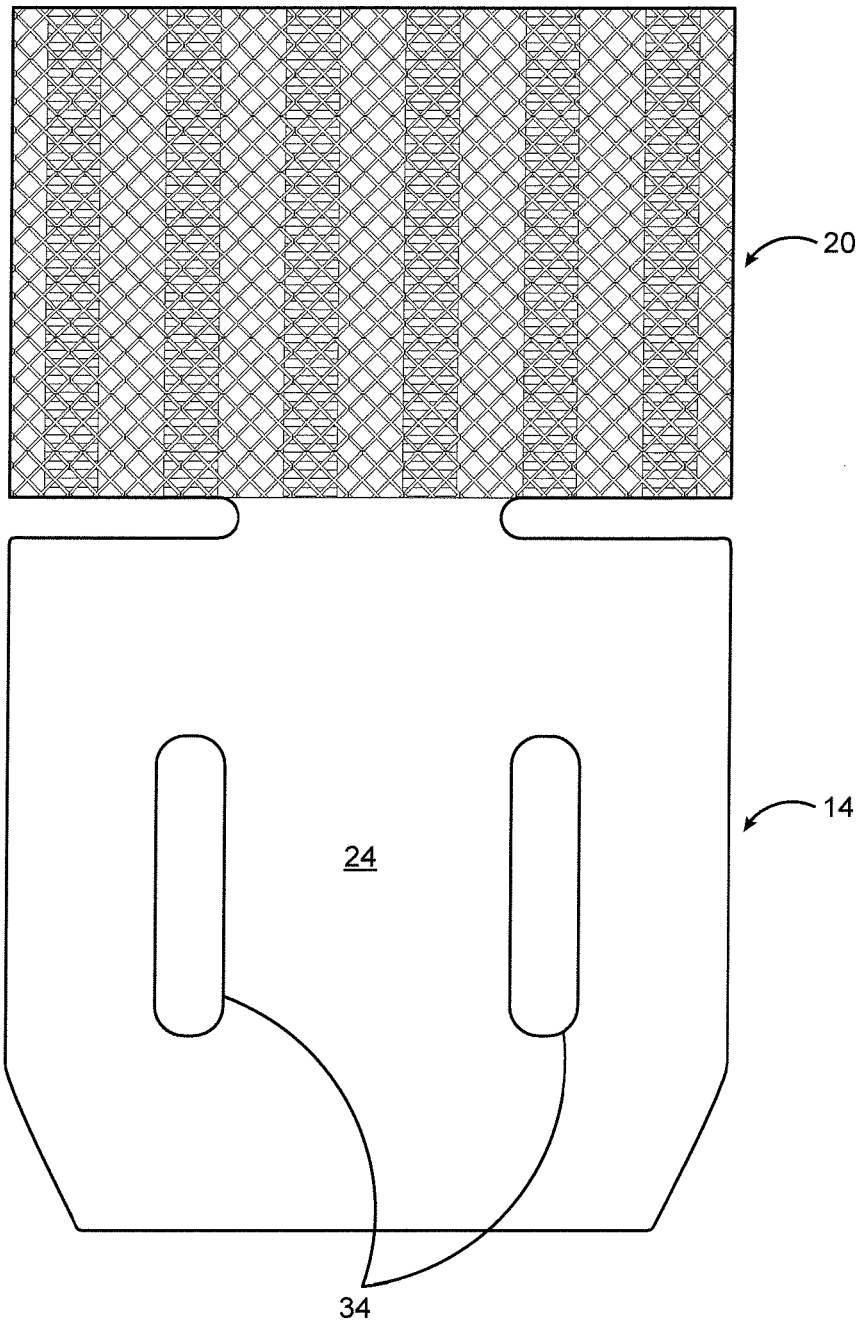
FIG. 5 shows a plan view of an alternate embodiment of the light reflector apparatus as it might appear in its natural resting shape prior to any application of mechanical force.

FIG. 5 presents an alternative embodiment of the light reflector apparatus 10 which employs the pliability of the attachment portion 14 to attach by mechanical force to temporary roadway stakes or similar elongate structures. Metal or wooden roadway stakes are often driven into the ground to temporarily define roadway shoulders, in one example. To these ends, attachment portion 14 is imparted with a pair of through holes 34 to receive the end of a stake 36 there through. Through holes 34 are preferably oblong and positioned parallel to each other and parallel with the long axis 31 of the light reflector apparatus 10.

Figure 6:
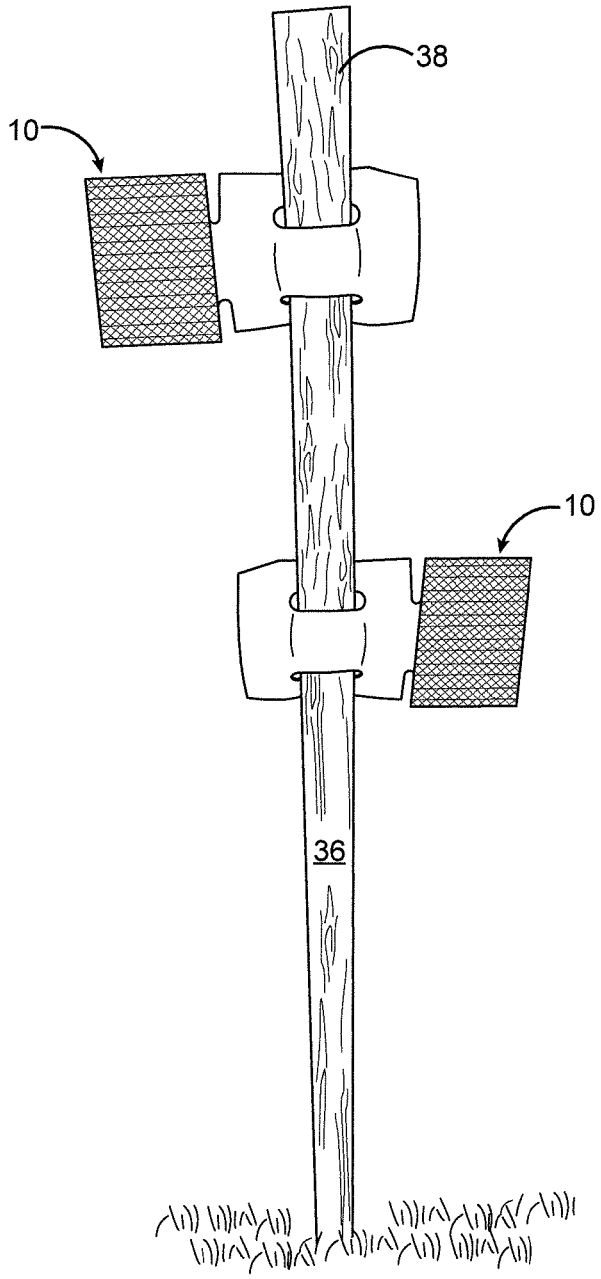
FIG. 6 shows the alternate embodiment of the light reflector apparatus introduced in FIG. 5, shown attached to a roadway stake.

FIG. 6 shows how the alternative embodiment of the light reflector apparatus 10 (introduced in FIG. 5) can be mounted onto a roadway stake 36. The upper end 38 of the stake 36 is threaded through the pair of through holes 34. The attachment portion 14 must be bent to accommodate the placement of the upper end 38 of the stake 36 through the through-holes 34. When threading is complete, the attachment portion 14 remains slightly bent due to its natural tendency to attempt to regain its natural shape as shown in FIG. 5, this slight bend applying mechanical force of the body of the attachment portion 14 against the sides 40 of the stake 36. The mechanical force applied by the attachment portion 14 provides a reliable method of attachment which stands up to heavy winds as well as buffeting caused by passing vehicles.

Figure 7:
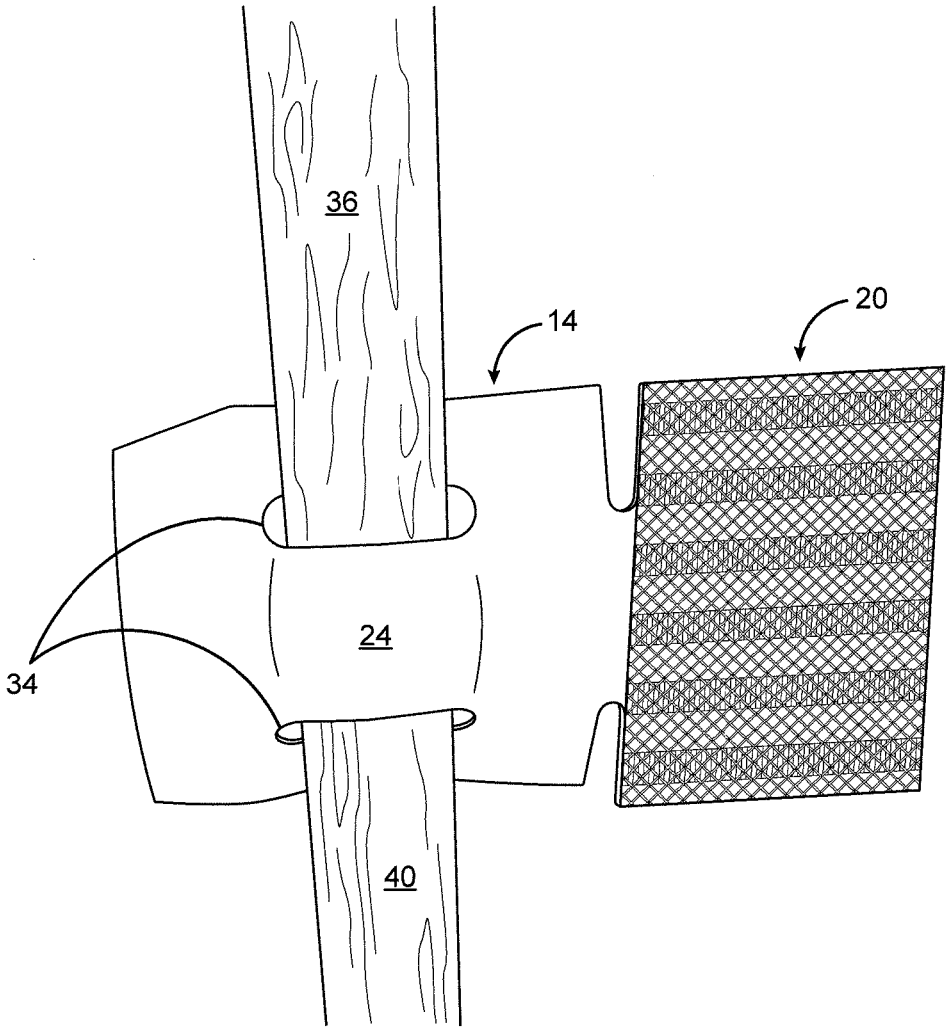
FIG. 7 is a close-up front view of the embodiment of the light reflector apparatus introduced in FIG. 5, shown attached to a roadway stake.
Figure 8:
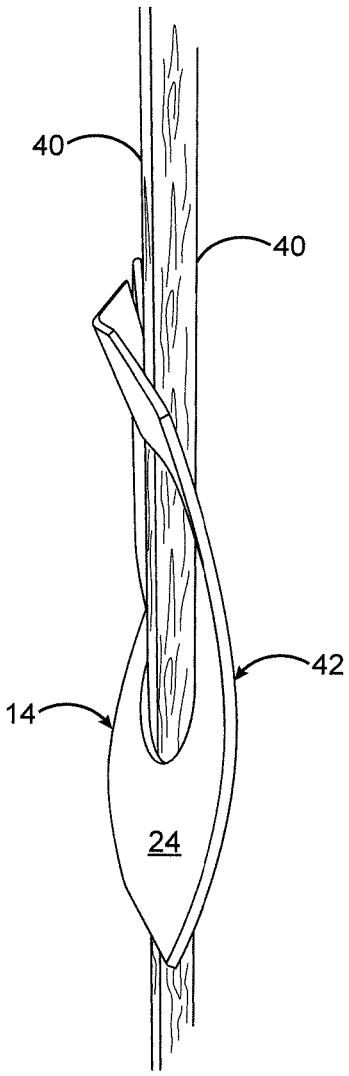
FIG. 8 is a close-up side view of the embodiment of the light reflector apparatus introduced in FIG. 5, shown attached to a roadway stake.

Referring also to FIG. 7 and FIG. 8, a close-up perspective of the alternate embodiment 10 attached to a stake 36 is shown. In FIG. 8, the threading of the stake 36 through the through-holes 34 is shown. The body 24 of the attachment portion is clearly bent 42 under mechanical force to hold the apparatus 10 onto the stake 36. In cases where a temporary stake 36 is used, the light reflector apparatus can be removed from the stake 36 and reused, when it is no longer needed.

Finally, although the description above contains much specificity, this should not be construed as limiting the scope of the invention, but as merely providing illustrations of some of the presently preferred embodiments of this invention. This invention may be altered and rearranged in numerous ways by one skilled in the art without departing from the coverage of any patent claims, which are supported by this specification.

The invention claimed is:

1. A light reflector apparatus comprising:

a light reflector portion;

an attachment portion coupled to said light reflector portion, said attachment portion comprising a body extending between a plurality of perimeter sides;

said attachment portion being flexibly moldable into a desired shape under an applied force to enable the fitment of said attachment portion into cavities of objects;

said body of said attachment portion tending to restore itself to a resting shape after being molded, wherein upon fitment of said molded attachment portion into a cavity of an object, said attachment portion tends to return to its resting shape and in doing so achieves mechanical purchase inside the cavity of the object;

said light reflector portion adjoining said attachment portion, said light reflector portion remaining visible outside of any cavity in which the attachment portion is placed.

2. The light reflector apparatus as recited in claim 1, further comprising a flexible bridge providing a connection between said light reflector portion and said attachment portion.

3. The light reflector apparatus as recited in claim 2, further comprising a first indention and a second indentation adjacent said flexible bridge, said first and second indentations and flexible bridge allowing said attachment portion an amount of play independent of said reflector portion so as to allow said attachment portion to be molded into a desired shape.

4. The light reflector apparatus as recited in claim 1, wherein said attachment portion further comprises first and second tapered sides.

5. The light reflector apparatus as recited in claim 4, wherein said first and second tapered sides, an end side, a first non-tapered side and a second non-tapered side define said plurality of perimeter sides of said attachment portion.

6. A light reflector apparatus comprising:

a light reflector portion;

an attachment portion coupled to said light reflector portion, said attachment portion comprising a body extending between a plurality of perimeter sides;

said attachment portion further comprising first and second through-holes imparted through said body of said attachment portion;

said attachment portion being flexibly moldable into a desired shape under an applied force to enable the fitment of said attachment portion into cavities of objects;

said body of said attachment portion tending to restore itself to a resting shape after being molded, wherein upon fitment of said molded attachment portion into a cavity of an object, said attachment portion tends to return to its resting shape and in doing so achieves mechanical purchase inside the cavity of the object;

said light reflector portion adjoining said attachment portion, said light reflector portion remaining visible outside of any cavity in which the attachment portion is placed.

7. The light reflector apparatus as recited in claim 6, wherein said first and second through-holes are oblong in shape and positioned parallel to one another.

8. The light reflector apparatus as recited in claim 7, wherein said first and second through-holes are oriented parallel with a long axis of said light reflector apparatus.

9. A light reflector apparatus comprising:

a light reflector portion;

an attachment portion joined to said light reflector portion by a flexible bridge, so that said attachment portion can articulate relative to said light reflector portion;

said attachment portion further comprising a body extending between a plurality of perimeter sides;

said body of said attachment portion being flexibly pliable under an applied force and moldable into a desired shape to enable the fitment of said attachment portion into cavities and crevices;

said light reflector portion and said attachment portion further being separated at a first indention and a second indentation adjacent said flexible bridge, said first and second indentations and flexible bridge allowing said attachment portion an amount of play independent of said reflector portion so as to allow said attachment portion to be molded into a desired shape.

* * * * *